United States Patent [19]

Kafka et al.

[11] 4,316,626

[45] Feb. 23, 1982

[54] FLUSH HASP HAVING DEPENDENT LATCHING PORTION, AND OPTIONALLY USABLE WITH PADLOCK

[75] Inventors: Charles F. Kafka, Bradenton; Robert S. Kafka, Maitland, both of Fla.

[73] Assignee: Meacham Marine Products, Inc., Sarasota, Fla.

[21] Appl. No.: 75,654

[22] Filed: Sep. 14, 1979

[51] Int. Cl.[3] ..... E05C 19/08

[52] U.S. Cl. ..... 292/285

[58] Field of Search ..... 292/281–287, 292/213, DIG. 48, 302, 304, 341.15, 341.17

[56] References Cited

U.S. PATENT DOCUMENTS

| | | | |
|---|---|---|---|
| 72,053 | 12/1867 | Levally | 292/341.15 X |
| 1,153,941 | 9/1915 | Miller | 292/281 X |
| 1,790,816 | 2/1931 | Hiering | 292/304 X |
| 3,828,899 | 8/1974 | Scott | 292/DIG. 48 X |
| 4,113,291 | 9/1978 | Cameron | 292/281 X |

*Primary Examiner*—Richard E. Moore

*Attorney, Agent, or Firm*—Julian C. Renfro

[57] ABSTRACT

A novel flush hasp for use in conjunction with a boat hatch or the like, the hasp having a base portion adapted to be placed in the boat deck adjacent the hatch, and a movable portion adapted to be secured to the hatch and thereby movable toward or away from engagement with the base portion. The base portion is provided with an aperture, and the movable portion is provided with a dependent member adapted to enter the aperture when the hatch is closed. The dependent member contains latching means adapted to be moved between a position in which engagement or disengagement of the hasp portions is readily permitted, and a motion-inhibiting or latching position. Locking means are provided for preventing on occasion, the latching means from being moved away from the motion-inhibiting position. The locking means includes a foldable loop hingedly mounted on the base portion, which can be moved to an upright portion such that it protrudes through an aperture in the movable portion such that the shackle member of a padlock can be applied in order to bring about locking of the hatch.

6 Claims, 12 Drawing Figures

FLUSH HASP HAVING DEPENDENT LATCHING PORTION, AND OPTIONALLY USABLE WITH PADLOCK

BACKGROUND OF THE INVENTION

It is well known that many types of hasps have been provided for use in connection with the securing of doors, gates, tool chests, cellar doors, cabinets and the like in order that these items may be secured and even padlocked to maintain them on occasion in the closed position.

Hasps have also been used on the deck hatches of boats in order that they may be padlocked to prevent theft of boat cushions, fishing equipment and the like from under-deck storage space when the boat owner is away, and the boat has been left moored to a dock, residing on its trailer, or the like. Unfortunately, most hasps have a fixed, upstanding loop residing $\frac{5}{8}''$ or more above the deck, designed to receive a padlock, with a large slotted portion of the hasp being designed to interfit with the loop. When the hasp is in its closed position, and a padlock put through the loop, the hatch cannot be opened. In addition, the hasps are ordinarily attached to the deck by a hinged heel plate screwed into the deck from above, typically creating a $\frac{1}{2}''$ projection at the hinge.

A fixed, upstanding loop ordinarily does not cause inconvenience when mounted on a door or gate, but when the loop is mounted either on a hatch, or the deck of the boat adjacent the hatch, the loop poses a safety threat in that the loop may well cause a person to trip, or if he or she steps on the loop wearing anything except hard-soled shoes, the upstanding loop may cause pain if not injury to the foot of the boater. Frequent breakage of the loop portion occurs, which is a major problem in deck mounted hasps.

It was for the purpose of overcoming the disadvantages attendant the use of ordinary hasps employed in the locking of hatches of a boat that we evolved several embodiments of a novel flush-hasp device, each of which represents a distinct advantage over the prior art.

SUMMARY OF THE INVENTION

In accordance with this invention, we have evolved a number of embodiments of hasps highly suitable for use on or in connection with the deck hatches of boats, or in other confined conditions, with these devices being characterized by the use of a non-rigid padlock-receiving loop that may, because of its hinged construction, be moved to a flat, nonprotruding position when padlocking is not needed. For example, when the boat is in use, and the boater desires occasional access to the storage space beneath the deck, no padlock need be involved, and the padlock-receiving loop may be in a flat position such that no upstanding obstruction is present on the deck over which he or anyone else on board may fall or trip. During this phase, a highly effective, non-key type latching of the hatch is brought about.

After the boat trip has been completed, for example, the boater can then move the padlock-receiving loop to its active or upstanding position, such that the padlock may be applied in order to prevent unauthorized entry into the storage space beneath the deck when the boat has been left unattended.

It is realized that hatches come in a range of sizes, so for use on large hatches, we provide a large hasp, having a movable member that is hinged, as well as being slotted such that it can interfit with the upstanding loop, with the hinged member being able to serve as a handle for the manipulation of the hatch. On the other hand, for medium and small hatches, we use hasps of somewhat different configuration in that the slotted member designed to engage the padlock-receiving loop is non-hinged, and bolted to protrude beyond the edge of the hatch so as to engage the loop when the loop has been moved to its upstanding position.

Within the spirit of this invention we may utilize any of several related hasp arrangements designed to hold a hatch in a latched position, even when it is not desired to utilize a padlock for preventing unauthorized entry into the hatch. In each embodiment, we utilize a base portion having an aperture therein, which base portion is designed to be affixed to the deck adjacent the hatch opening. This base member is in the nature of a striker plate and has a central hole designed to receive a downwardly-protruding member affixed to the principal or movable portion of the hasp.

In one embodiment, a tooth may be provided on the bottom of the downwardly-protruding member, which is designed to engage a lower edge of the striker plate. Release of the latch is effected when the dependent member is caused to pivot about a horizontal axis for a limited number of degrees, such that the tooth moves away from engagement with the striker plate.

Another embodiment of this invention utilizes a foot member provided on the bottom of the downwardly protruding member, which foot member is enabled to be rotated between latching and unlatching positions with respect to the striker plate. The foot member is rotatable about a vertical axis in normal installations, and preferably, rotation of the foot between latching and unlatching positions is brought about by the use of a hinged member located on the principal portion of the hasp. When this hinged member is in a vertical position, it is usable as a handle, but at all other times it resides in a flattened position, so as to minimize the chance of a boater tripping over any portion of the hasp.

It is to be noted that in all of these embodiments, there is no fixed upstanding member that would trip or injure a boater, except of course when he has decided to apply a padlock in order to effect a locking of the hatch. Normally, a boat would not be operated with locked deck hatches, so it may accurately be stated that there are few occasions that any component of our hasp would be in a position to cause a boater to trip or be injured.

It is therefore, a principal object of this invention to provide a basic new hasp concept making it possible to effectively utilize a hasp on deck hatches without presenting an upstanding portion or component likely to cause injury to a boater.

It is another object of this invention to provide a hasp of low cost and essentially flat construction which on the one hand effectively serves as a latching means for a hatch or the like, and on the other hand can be adapted for use with a padlock such that unauthorized entry can be effectively prevented.

It is still another object of this invention to provide rattle-free novel hasp arrangements usable with or without a padlock, with effective, non-key type latching being obtainable even when the padlock is not used.

It is yet still another object of this invention to provide hasp embodiments usable in either a latching or a locking mode, with the principal member of the hasps either being hingedly attached such that it may be used as a handle-like member in the case of a large hatch, or bolted firmly to the edge of the hatch in the case of medium and small size hatches.

These and other objects, features and advantages will become more apparent as the description proceeds.

Figure 5:
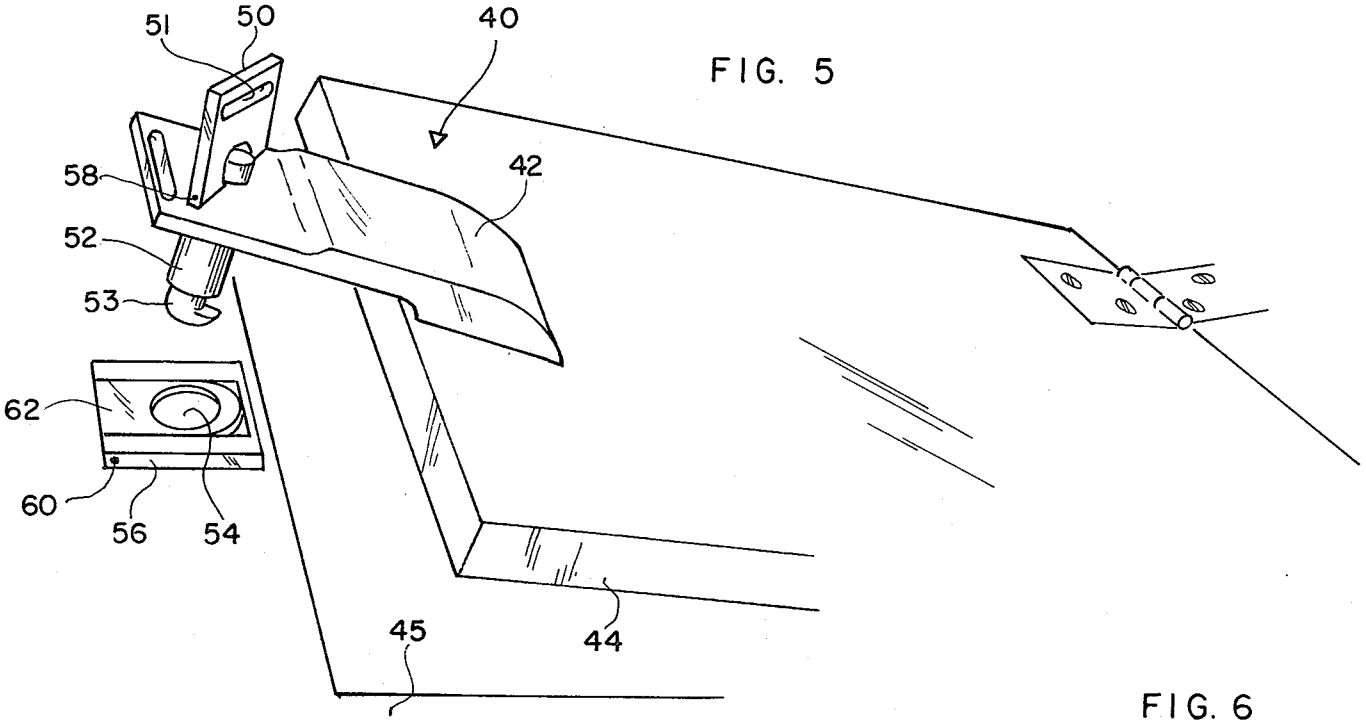
FIG. 5 is a view of an embodiment of our invention in which latching and unlatching is effected by the use of a rotatable foot member located on the bottom of a dependent member.
Figure 7:
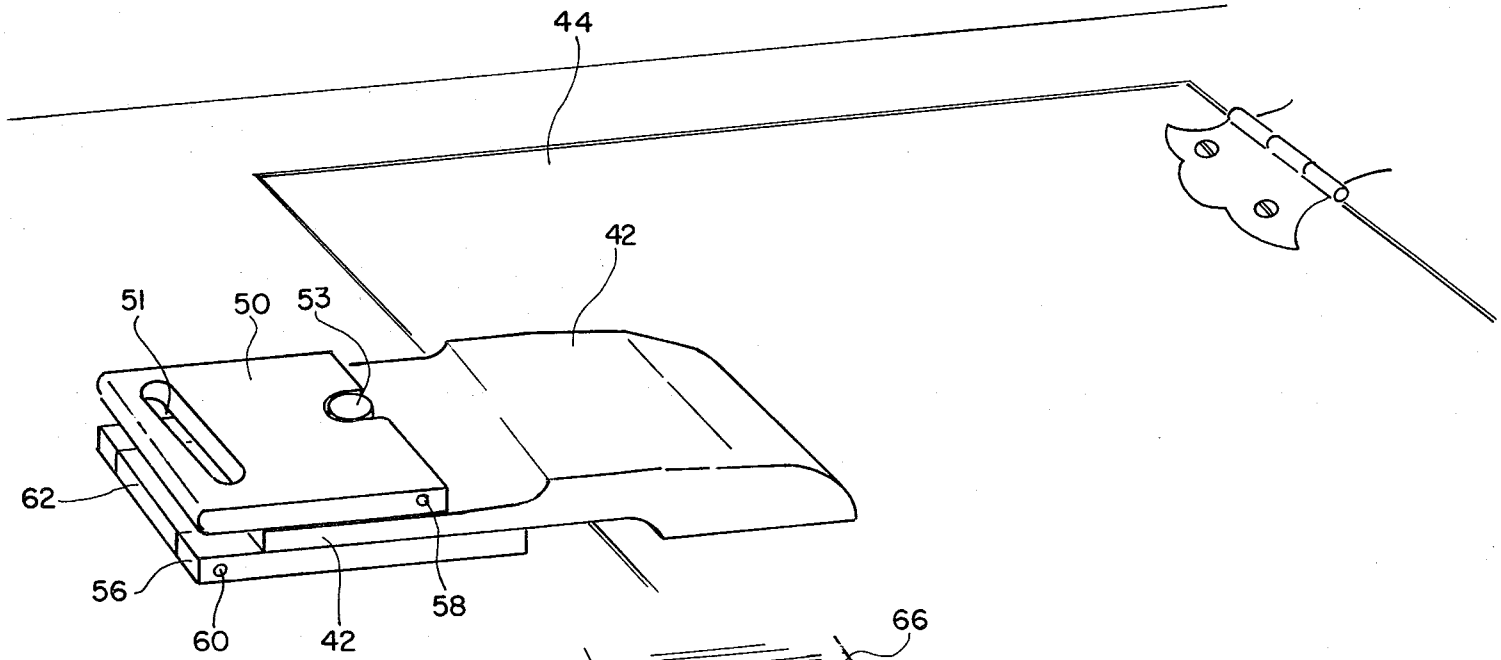
Figure 8:
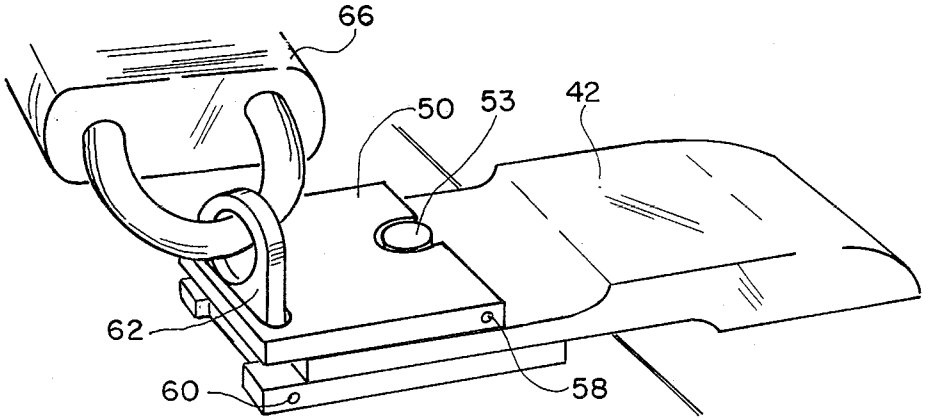
Figure 10:
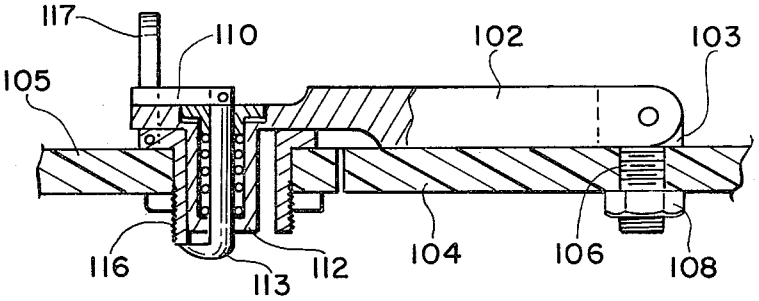
Figure 11:
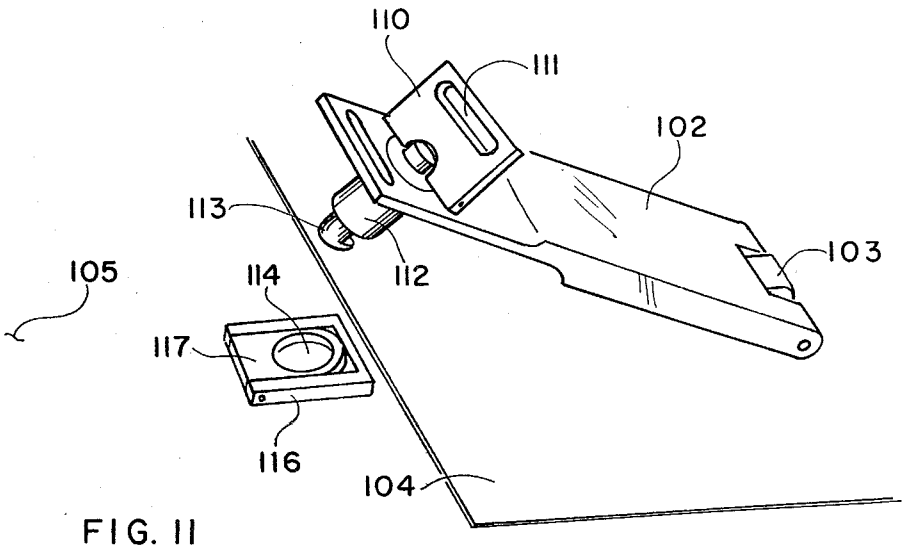
Figure 9:
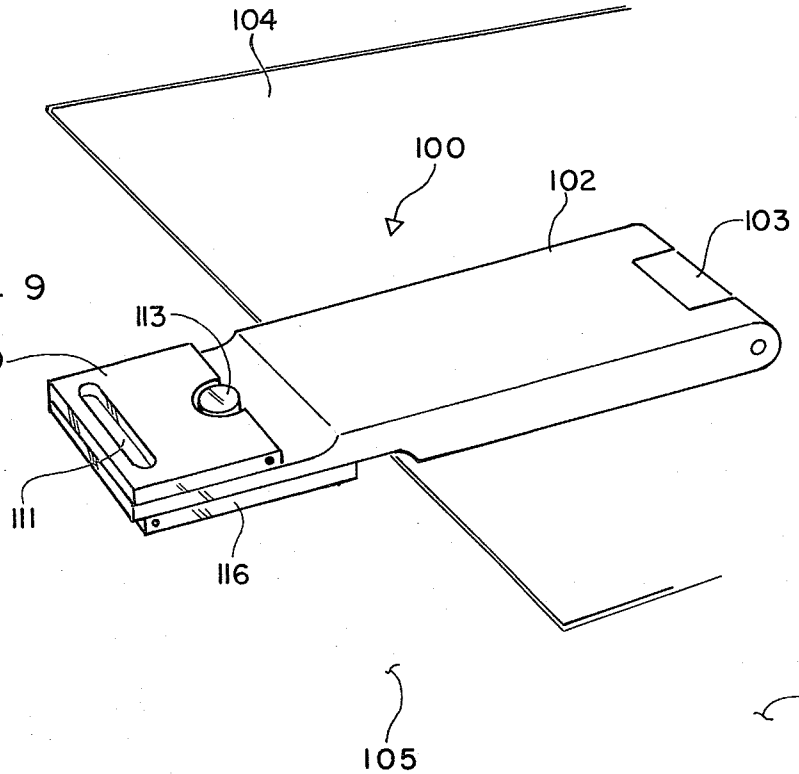

FIG. *6a* is a fragmentary perspective view of the base member to be engaged by the foot member;

FIG. 7 is a view to a larger scale of the embodiment of FIG. 5 when the hasp is in its latching position;

FIG. 8 is a view similar to that of FIG. 7, but showing the application of a padlock to prevent unauthorized entry into the hatch;

FIG. 9 is an embodiment usable with large hatches in that the principal hasp member is hingedly attached to the hatch;

FIG. 10 is a sectional view to a slightly smaller scale of the embodiment of FIG. 9; and FIG. 11 is a view of the hasp embodiment of FIGS. 9 and 10 in which the principal hasp member has been moved somewhat away from the hatch, and from the position in which its base portion is engaged.

DETAILED DESCRIPTION

Figure 1:
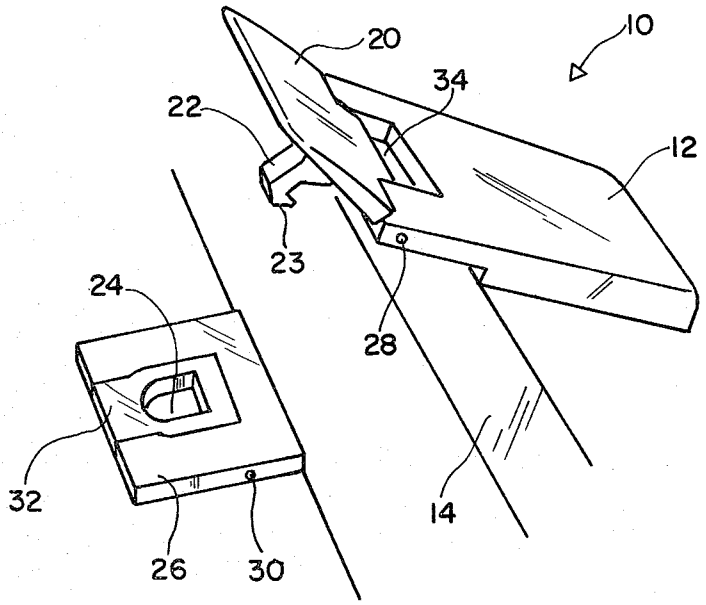
FIG. 1 is a perspective view of a fist embodiment of our novel hasp, with the hatch upon which the hasp is mounted being in a slightly opened position in order to reveal constructional details of the hasp.
Figure 2:
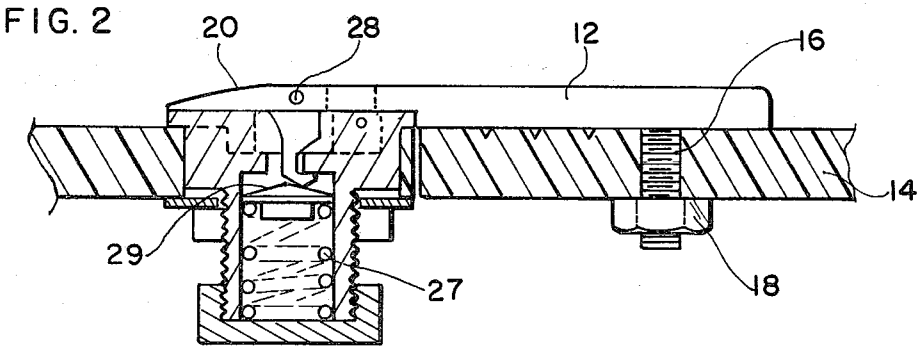
FIG. 2 is a vertical sectional view taken through the hasp components in order to reveal the manner in which latching takes place.

Turning to FIG. 1, it will there be noted that we have provided a first embodiment 10 of our novel hasp, involving a principal hasp member 12 rigidly mounted on the edge of a hatch 14 of a boat or the like. The member 12 may be secured firmly to the hatch by the use of a bolt 16 integral with the underside of the member 12, upon which bolt a nut 18 is employed, as seen in FIG. 2. Undesirable movement of the member 12 with respect to the hatch may be minimized by providing serrations on the underside of member 12, where it contacts the hatch.

Figure 3:
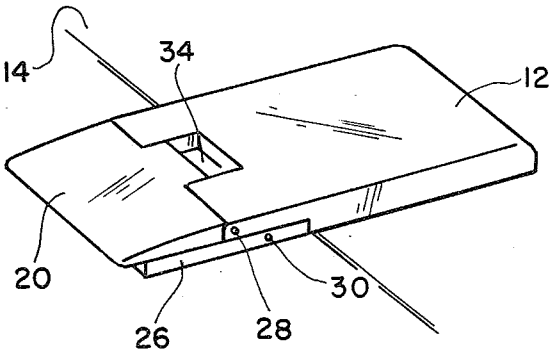
FIG. 3 is a view showing the latch in a closed position on a deck, in which position any obstruction to the deck is minimized.

Hingedly secured to the overhanging end of the member 12 is a pivoted member 20 that is movable between the upward, latch-releasing position shown in FIG. 1, and a position parallel to the member 12 as depicted in FIGS. 2 and 3, in which latching is effected.

On the underside of the pivotally mounted member 20 is a latch member 22, which extends downwardly from the member 20 for a sufficient distance that it can enter hole 24 in the striker plate 26 when the hatch 14 is in the closed position, with this non-key type latching arrangement effectively holding the hatch in the closed position until such time as the pivotally mounted member 20 is raised away from the position shown in FIG. 2. The dependent latch member 22 has a tooth 23 at its lower end that can engage the appropriate portion of the base portion 26 in a rattle-free manner, as revealed in FIG. 2.

Figure 4:
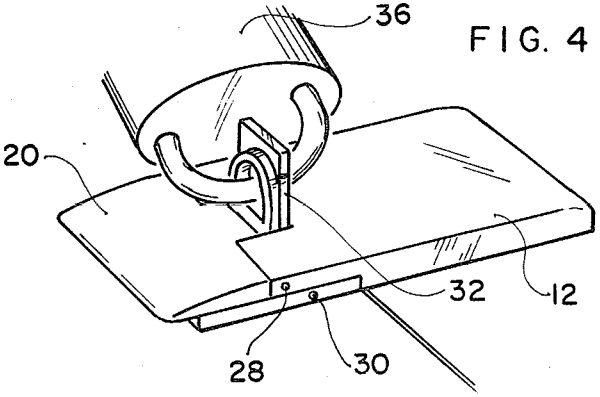
FIG. 4 is a view similar to FIG. 3, but showing the application of a padlock to the hasp such that unauthorized entry into the associated hatch can be effectively prevented.

Two pivot pins are used in this embodiment, with pivot pin 28 being utilized at the end of the principal hasp member 12 in order to form a hinge point about which the member 20 on occasion can rotate. A pivot 30 is associated with the striker plate 26, and it is about this latter pivot that the padlock-receiving loop 32 may on occasion be rotated from the flush or flattened position shown in FIGS. 1 and 2, to the raised position shown in FIG. 4.

An aperture 34 is provided at the end of the member 12 adjacent the hinge 28 and it is through this aperture that the loop member 32 extends in a close-fitting relationship when the user would like to secure the hatch of his boat or other vehicle against thievery. On such occasion, he need only lift the member 32 to the upright position, move the aperture 34 over the member, close the hatch such that the member 32 extends through the aperture, and then apply the shackle portion of the padlock 36 through the central hole in the member 32. Note FIG. 4.

As is obvious, the user will want to unlock the padlock at the time of next use of the boat, and at that time he may elect to fold the member 32 back into the recessed position shown in FIGS. 1 and 2 such that ordinary latching, rather than padlocking of the hatch, can take place.

As should now be apparent, the dependent member 22 is movable into and away from the latching position by virtue of movements of the member 20 about its hinge point 28. In other words, when the hatch is first closed, the member 20 is in the position shown in FIG. 1, but upon movement of member 20 to the flattened position of FIG. 2 subsequent to hatch closure, effective latching is brought about as a result of engagement of the tooth 23 with a portion of the base portion or striker plate 26. Retention in this latter position may be assured by the use of a spring 27 which biases a dome-shaped or somewhat conically shaped plate 29 into contact with the bottom of the member 22, thus to inhibit undesired motion and any tendency to rattle. Opening of the hatch of course commences with the member 20 being raised so as to move the tooth 23 away from contact with the base plate 26.

Figure 6:
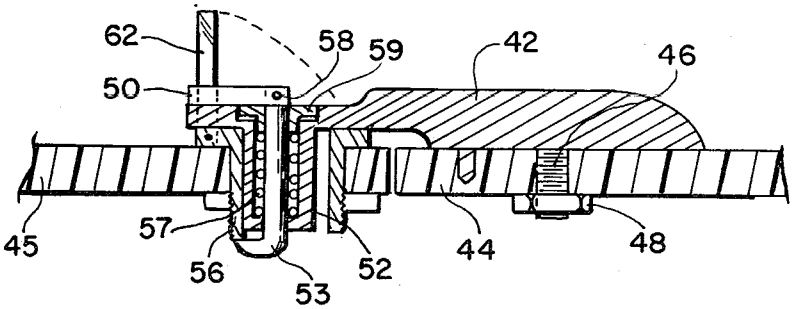
FIG. 6 is a vertical section through the components of the embodiment of FIG. 5.

Turning to the embodiment commencing with FIG. 5, it will there be seen that we have provided a second embodiment 40 of our novel hasp, involving a principal hasp member 42 rigidly mounted on the edge of the hatch 44, with the member 42 being secured firmly to the hatch by the use of a bolt 46 integral with the underside of member 42, upon which bolt a nut 48 may be employed, as illustrated in FIG. 6. By maintaining the nut 48 sufficiently tight, any undesirable rotation of the hasp member 42 with respect to the hatch 44 may be prevented. Serrations or a deck-engaging pin may be used on the hatch-contacting portion of member 42 in order to further inhibit undesired rotation.

A latching means involving a hinged handle 50 is employed in the overhanging portion of the member 42, with the latch mechanism including a rigid, downwardly extending portion 52 designed to enter the hole 54 in the striker plate or base portion 56 at such time as the hatch 44 has been moved to the closed position. On the lower end of dependent member 52 is a rotatable foot 53, that rotates in this instance about a vertical axis, and in response to rotative movements of the handle member 50 about such vertical axis. The striker plate 56 is mounted in deck 45.

Figure 6A:
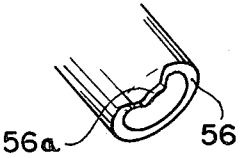

As best seen in FIG. 6, when the handle 50 has been rotated to the position shown, this causes the laterally-extending portion of the foot 53 to engage an underportion of the striker plate 56 as revealed in this figure, thus to effectively hold the hatch in the latched position. We prefer to configurthe underside of the striker plate to have a downwardly-extending portion 56*a*, as shown in FIG. 6*a*, in order to most effectively receive the foot 53.

It is thus to be seen that rotation of the member 50 about its vertical axis is responsible for bringing about rotary movement of the foot member 53 such that non-key type latching or unlatching of the hatch may be effected as desired. As will be noted, the member 50 is secured to the upwardly extending portion of foot member 53 by means of pin 58. Rotation of the member 50 about pivot point 58 to the vertical position shown in FIG. 5 makes it possible for the boater to have effective control over rotary movements of the foot 53 so that on the one hand the foot 53 can be moved into a non-interfering position such that the hatch can be lifted, and on the other hand, the foot moved into a tightly wedged relationship to portion 56*a* on the underside of the base member 56 such that latching of the hatch in a highly effective and rattle-free manner is brought about.

We prefer to utilize a compression spring 57 in a suitable cavity in dependent member 52, with the lower end of the spring resting against the lower wall of the spring cavity. The upper end of the spring presses against a washer-like member 59 surrounding the vertically extending portion of member 53, which member 59 is in contact with the base portion of the handle member 50. Because of this arrangement, the laterally-extending portion of the foot member 53 is biased upwardly into a rattle-free relationship to the seat portion 56*a*, and furthermore, the pivoted member 50 is prevented from flopping between its vertical and horizontal positions. The base portion of the member 50, that is, the portion immediately adjacent the pin 58, preferably has non-rounded or square corners, such that the washer-like bushing 59 biased against the base of member 50 will cause latter member to remain either in a flat or an upright position, but not in an intermediate position.

FIG. 7 reveals with respect to this same embodiment, the position of the member 50 when the hath has been latched but not locked, and in this instance the padlock-receiving loop member 62 is in a folded position atop the base member 56. However, when it is desired to padlock the hatch 44, it merely entails the user pivoting the member 62 out of its recess and about its pivot point 60, so as to bring it to the vertical position shown in FIG. 8. It is then only necessary to bring the member 50 down over the member 62, with the slot 51 in the member 50 then receiving the member 62. At this point the shackle member of padlock 66 may be applied through the central aperture in member 62 in order to bring about a locking of the hatch.

As is obvious, upon removal of the padlock the next time the hatch is to be opened, the user may by proper utilization of the member 50 bring about selective latching or release of the hatch without it being necessary to relock same, with the member 62 folded into its recess in the manner shown in FIG. 5.

Turning to an embodiment to be utilized when installation of our novel hasp on a large hasp is desired, in FIG. 9 it will be noted that we reveal a hasp assembly 100 involving a principal hasp member 102 having a pivotal mounting on hatch 104. As revealed in FIG. 10, the principal hasp member 102 is pivotally attached to a base portion 103 that is in turn secured to the hatch 104 by means of a bolt 106 equipped with a nut 108 on the underside of the hatch 104, as best seen in FIG. 10. Inasmuch as the principal hasp member 102 can be pivoted for a substantial distance away from the hatch 104 in the manner shown in FIG. 11, the member 102 can be effectively utilized as a handle for the manipulation of the hatch 104 between open and closed position.

Mounted in the deck 105 at a location immediately forward of the member 102 is a striker plate 116 having a hole 114 therein to receive downwardly dependent latch member 112, with the details of this relationship being most easily visible in FIG. 10. On the underside of the member 112 is a rotatable foot member 113 which can be moved toward and away from the latching position shown in FIG. 10 by means of rotation of the pivoted member 110 about its vertical centerline.

As described in connection with FIG. 6, we utilize in the embodiment of FIG. 10, a compression spring surrounding the vertically-disposed portion of the member 113 in order to bias the laterally-extending foot portion of member 113 into firm, rattle free contact with its striker plate 116, and also to prevent undesirable motion of member 110.

As will now be apparent, when the member 110 is in the orientation revealed in FIG. 11, the foot member 113 can easily enter the hole 114 in the striker plate 116, whereas when the member 110 has been rotated about a vertical axis to an orientation 180 degrees away, the member 113 is caused to engage the lower edge of the striker plate 116 in the manner shown in FIG. 10, thus locking the hatch 104 against desired upward movement.

A slot 111 in the member 110 makes it possible for padlock loop 117, when it has been lifted out of its recess and pivoted into its vertically extending position, to extend therethrough such that a padlock can be utilized for locking the hatch.

We claim:

1. A hasp having a base portion, and a portion movable toward and away from engagement with said base portion, said base portion having an aperture therein, and said movable portion having a dependent member adapted on occasion to enter said aperture, said dependent member having latching means adapted to be moved between a position in which engagement and disengagement of said portions is readily permitted, and a motion-inhibiting position, and locking means for preventing on occasion, said latching means from being moved away from the motion-inhibiting position, said locking means taking the form of a closed loop hingedly mounted on said base portion, said closed loop, when moved out of a recessed position on said base portion and into an upstanding position, being able to be inserted through a slot in said movable portion, and thereafter adapted to receive the shackle member of a padlock.

2. A hasp having a base portion, and a portion movable toward and away from engagement with said base portion, said base portion having an aperture therein, and said movable portion having a dependent member adapted on occasion to enter said aperture, said dependent member having latching means adapted to be moved between a position in which engagement and disengagement of said portions is readily permitted, and a motion-inhibiting position, and locking means for preventing on occasion, said latching means from being moved away from the motion-inhibiting position, said dependent member involving a toothed member adapted to engage a striker plate in said base member, said hasp including a member normally coplanar with said movable member, adapted for moving said toothed member into and out of engagement with said striker plate.

3. A hasp adapted for use in conjunction with a boat hatch or the like, said hasp having a base portion adapted to be placed in the deck adjacent a non-hinged edge of the hatch, and a movable portion adapted to be secured to the hatch and movable toward and away from the base portion, said base portion having an aperture therein, and said movable portion having a dependent member adapted to enter said aperture when the hatch is closed, said dependent member having latching means adapted to be moved between a position in which engagement and disengagement of said hasp portions is readily permitted, and a motion-inhibiting position in which said portions are latched together, and locking means for preventing on occasion, said latching means from being moved away from the motion-inhibiting position, said locking means taking the form of a closed loop hingedly mounted on said base portion, said closed loop, when moved out of a recessed position on said base portion and into an upstanding position, being able to be inserted through a slot in said movable portion, such that it may thereafter receive the shackle member of a padlock.

4. A hasp having a base portion, and a portion movable toward and away from engagement with said base portion, said base portion having an aperture therein, and said movable portion having a dependent member adapted on occasion to enter said aperture, said dependent member having latching means adapted to be moved between a position in which engagement and disengagement of said portions is readily permitted, and a motion-inhibiting position, and locking means for preventing on occasion, said latching means from being moved away from the motion-inhibiting position, said dependent member being provided with a foot member rotatable by means of a foldable handle, said foot member when in one orientation, permitting said hasp portions to be disengaged, and when in another orientation, bringing about latching of said portions together, said base portion having a closed loop hingedly mounted thereon, which loop on occasion can be moved out of a recessed position and into an upstanding position, said foldable handle having therein an aperture for receiving such closed loop when said loop has been moved to its upstanding position, said loop being adapted for receiving the shackle member of a padlock after said loop has passed through said foldable handle.

5. A hasp adapted for use in conjunction with a boat hatch or the like, said hasp having a base portion adapted to be placed in the deck adjacent a non-hinged edge of the hatch, and a movable portion adapted to be secured to the hatch and movable toward and away from the base portion, said base portion having an aperture therein, and said movable portion having a dependent member adapted to enter said aperture when the hatch is closed, said dependent member having latching means adapted to be moved between a position in which engagement and disengagement of said hasp portions is readily permitted, and a motion-inhibiting position in which said portions are latched together, and locking means for preventing on occasion, said latching means from being moved away from the motion-inhibiting position, said dependent member involving a toothed member adapted to engage a striker plate in said base member, said toothed member being mounted upon a member hingedly attached to said movable member, latter member being normally coplanar with said movable member, but liftable by a user out of such plane when release of said toothed member from said striker plate is desired.

6. A hasp for use in conjunction with a boat hatch or the like, said hasp having a base portion adapted to be placed in the deck adjacent a non-hinged edge of the hatch, and a movable portion adapted to be secured to the hatch and movable toward and away from the base portion, said base portion having an aperture therein, and said movable portion having a dependent member adapted to enter said aperture when the hatch is closed, said dependent member having latching means adapted to be moved between a position in which engagement and disengagement of said hasp portions is readily permitted, and a motion-inhibiting position in which said portions are latched together, and locking means for preventing on occasion, said latching means from being moved away from the motion-inhibiting position, said dependent member being provided with a rotatable foot member operable by a foldable handle, said foldable handle having an aperture for receiving a closed loop hingedly secured to said base portion, when said closed loop has been moved to an upright, padlock-receiving position, said foot member when in one orientation, permitting said hasp portions to be readily disengaged, and when in another orientation, causing the latching of said portions together.

* * * * *